US007589701B2

(12) United States Patent
Sempel

(10) Patent No.: US 7,589,701 B2
(45) Date of Patent: Sep. 15, 2009

(54) SYSTEMS AND METHODS FOR DRIVING A DISPLAY DEVICE AND INTERRUPTING A FEEDBACK

(75) Inventor: Adrianus Sempel, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 381 days.

(21) Appl. No.: 10/525,134

(22) PCT Filed: Jul. 18, 2003

(86) PCT No.: PCT/IB03/03281

§ 371 (c)(1),
(2), (4) Date: Feb. 16, 2005

(87) PCT Pub. No.: WO2004/019311

PCT Pub. Date: Mar. 4, 2004

(65) Prior Publication Data

US 2006/0071882 A1 Apr. 6, 2006

(30) Foreign Application Priority Data

Aug. 21, 2002 (EP) ..... 02078454

(51) Int. Cl.
*G09G 3/32* (2006.01)

(52) U.S. Cl. ..... 345/82; 345/204

(58) Field of Classification Search ..... 345/211, 345/210, 204, 84–102, 55, 205, 214; 315/169.3
See application file for complete search history.

(56) References Cited

U.S. PATENT DOCUMENTS

| | | | | |
|---|---|---|---|---|
| 5,594,463 | A * | 1/1997 | Sakamoto | 345/76 |
| 5,926,156 | A * | 7/1999 | Katoh et al. | 345/55 |
| 6,014,119 | A | 1/2000 | Staring et al. | |
| 6,456,282 | B1 * | 9/2002 | Karube | 345/204 |
| 6,603,456 | B1 * | 8/2003 | Aoki et al. | 345/100 |
| 2001/0043168 | A1 | 11/2001 | Koyama et al. | |
| 2003/0160247 | A1 * | 8/2003 | Miyazawa | 257/79 |

* cited by examiner

*Primary Examiner*—Chanh Nguyen
*Assistant Examiner*—Pegeman Karimi

(57) ABSTRACT

In a driver for a luminescent display the operating voltage of a driver circuit is monitored to prevent extra dissipation due to open output connections (28) of the driver circuit. The monitoring is also used for minimizing power dissipation.

14 Claims, 4 Drawing Sheets

SYSTEMS AND METHODS FOR DRIVING A DISPLAY DEVICE AND INTERRUPTING A FEEDBACK

This application is a 371 PCT/IB03/03280 Jul. 18, 2003.

BACKGROUND INVENTION

The invention relates to a display device comprising at least one picture element and a display driver device comprising a driving transistor to be connected in series with the picture element.

Such display devices are increasingly based on electroluminescent semiconducting organic materials, also known as light emitting diodes (polyLEDs or OLEDs). The display devices may either luminesce via segmented pixels (or fixed patterns) but also display by means of a matrix pattern is possible. The adjustment of the diode current generally determines the intensity of the light to be emitted by the pixels.

Suitable fields of application of the display devices are, for example, mobile telephones, organizers, etc.

DESCRIPTION OF PRIOR ART

A display device of the type described in the opening paragraph is described in U.S. Pat. No. 6,014,119. In said document, the current through a LED is adjusted by means of current control. For each column of pixels in a matrix of luminescent pixels a current driver comprising a bipolar transistor and a resistor is provided as part of a driving circuit. In stead of the bipolar transistors MOS- or TFT-transistors may be used.

To obtain reproducible gray scales the current has to be substantially constant for a certain gray value. This is the reason why the transistors are generally used in the constant current region. In this case a high drain-source voltage (or emittor-collector voltage in the case of bipolar transistors) is used. This makes the bias of the transistor less sensitive to variations in the drain voltage due to variations in for instance the forward characteristics of the pixel diodes or the supply voltage of the driver.

A problem however arises in large volume production of both display devices and display driver circuits, since the number of outputs of the driver circuit may be larger than the number of columns to be provided with driving current. These output drivers may be put on, e.g. when the information supplied in the driving circuits (for e.g. the columns at an edge of the display) is not essential for a reasonable picture to be displayed or when the number of columns in the display is smaller than the number of column driver outputs available in the driver circuit. Since the output driver functions as a current source its output node rapidly increases (or decreases) in voltage, the increase being limited by the supply voltage. A similar increase occurs if a column connection has broken down. The voltages at the output nodes are monitored to maintain a certain voltage value between the supply node and the output nodes to keep the current supplies in a certain working area. Now, if one of the output nodes increases in voltage the supply node voltage also increases, causing the output node to increase, etc.

This leads to excess dissipation both in the display device and display driver circuit.

Apart from this the output current (or an output node voltage) may vary due to temperature change, while also different column drivers (and also different columns) may differ in their behavior.

SUMMARY OF INVENTION

It is, inter alia, an object of the present invention to provide a display device of the type described in the opening paragraph in which variations in the output node voltages and in dissipation is minimal and especially in which extra power dissipation due to an open driver output node is prevented as much as possible. To this end in a display device according to the invention elements the display driver device comprises means for monitoring output voltages of the display driver device ( e.g. for signaling the value of an output voltage to reach a threshold voltage).

A preferred embodiment of a display device according to the invention comprises and a feedback mechanism to control a reference voltage of the display driver device. The reference voltage generally will be the supply node voltage but also it may be a voltage determining, directly or indirectly, said supply node voltage or any other suitable voltage node. Via the feedback mechanism the voltage value between the supply node and the output nodes is kept substantially constant (at such a value that the current supplies remain in a certain working area (the constant current area)) without giving this voltage value an excessively high value. To this end the feedback mechanism preferably comprises a control circuit signaling the difference between an output voltage of the display driver device for a picture element and the reference voltage being below a threshold voltage. To prevent extra power dissipation due to an open driver output node the display driver device comprises means for detecting after the signaling an open output of the display driver device.

In a preferred embodiment the means for detecting an open output of the display driver device comprise a current path comprising part of the means for monitoring output voltages. Said means for detecting may comprise a switch in the current path between the reference voltage and the output of the display driver device or a fuse in the current path between the reference voltage and the output of the display driver device.

BRIEF DESCRIPTION OF DRAWINGS

These and other aspects of the invention are apparent from and will be elucidated with reference to the embodiments described hereinafter.

In the drawings:

FIG. 3 shows an embodiment of the invention, while

DETAILED DESCRIPTION

Figure 1:
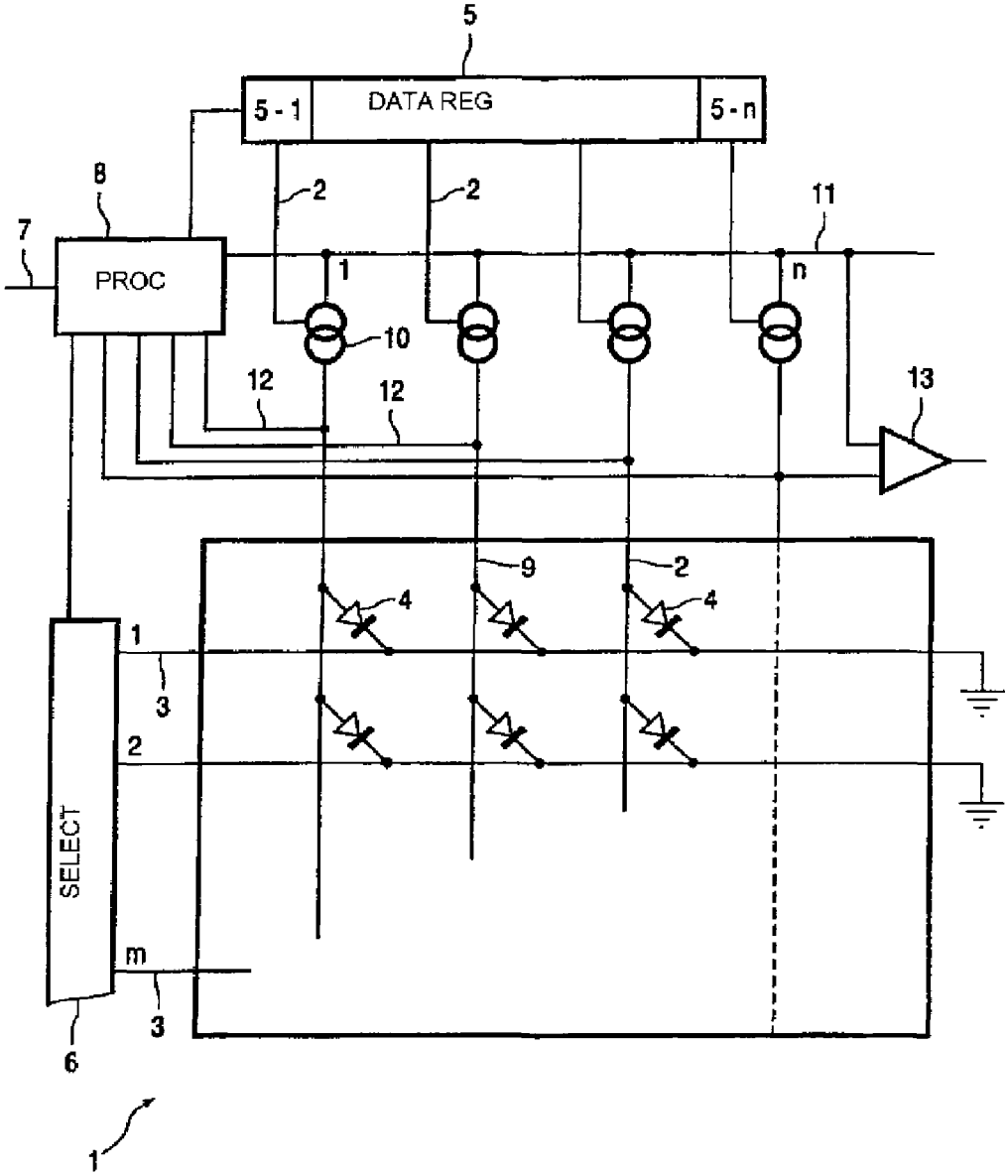
FIG. 1 shows diagrammatically a display device according to the invention.

FIG. 1 shows diagrammatically an equivalent circuit diagram of a part of a display device 1 according to the invention. This display device comprises a matrix of (P) LEDs or (O) LEDs 4 with m rows (1, 2, . . . , *m*) and n columns (1, 2, . . . , *n*). This device further comprises a row selection circuit 6 and a data register 5. Externally presented information 7, for example, a video signal, is processed in a processing unit 8 which, dependent on the information to be displayed, charges the separate parts 5-1, . . . , **5-*n* of the data register 5 via lines 9**.

The selection of a row takes place by means of the row selection circuit 6 via the lines 3, in this example by providing them with the required selection voltage (passive addressing).

Writing data takes place in that, during selection, a current source 10, which may be considered to be an ideal current source, is switched on by means of the data register 5, for example via (not shown) switches. The value of the current is determined by the contents of the data register and is supplied via a voltage supply line 11 to the LEDs 4 via data lines 2. The voltage line 11 may be provided externally or be derived from voltages within the processing unit 8.

The current switches 10 may be of a simple type, each comprising just one transistor and one resistor. As explained in the introduction, to make the bias of the transistor less sensitive to variations in the drain voltage due to variations in for instance the forward characteristics of the pixel diodes or the supply voltage of the driver, the transistors are generally used in the constant current region. The high drain-source, needed then, however increases power dissipation especially when different columns differ in their driving behavior. The latter may also lead to non-uniform emission behavior.

Figure 2:
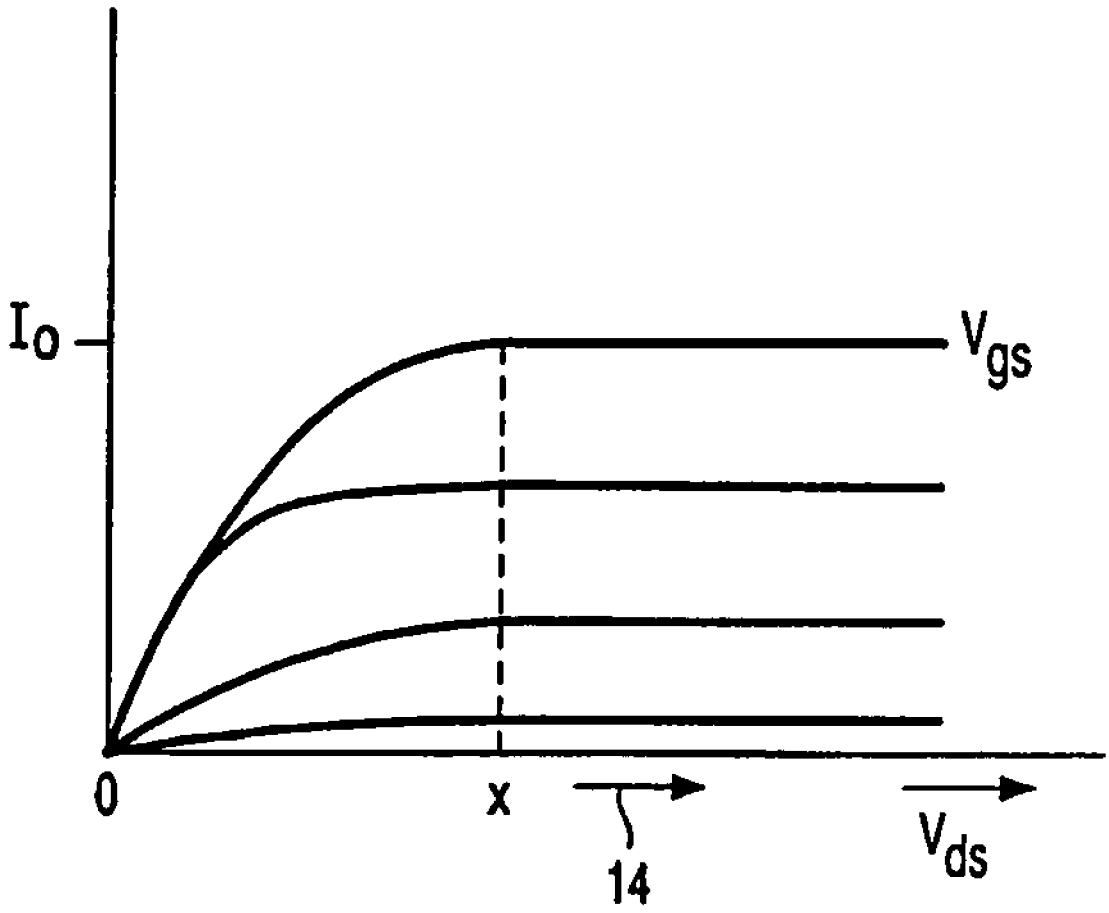
FIG. 2 shows transistor characteristics of the transistors used in the embodiment of FIG. 1.

According to a first aspect of the invention the display driver device (comprising in this example the row selection circuit 6, the data register 5, the processing unit 8 and current drivers 10) also comprises a monitoring circuit, in this example an operational amplifier 13 for monitoring its output voltages and to control via a feedback mechanism a reference voltage of the display driver device. Although shown as a separate component the operational amplifier 13 generally forms part of the processing unit 8. The values of the operating voltages $V_{op}$ are monitored by means of interconnections 12. To keep dissipation within the driver at a low level the $V_{ds}$ value is biased at point x which allows a (maximum) value for $I_0$ at this $V_{ds}$ value (see FIG. 2). Via the operational amplifier the voltage $V_{supply}$ at the voltage line 11 is maintained at $V_{op}+V_{ds}$. Since the voltages $V_{op}$ may show some variation the processing unit 8 tends to maintain the voltage line 11 is at $V_{op,max}+V_{ds}$, so the operating point x will drift to higher voltages as shown by arrow 14 in FIG. 2. This may be used for detecting end of life of the display (or the display driver device) by simply comparing $V_{op,max}$. with a reference voltage in the processor 8. The reference voltage may be generated within the processor 8 or be supplied externally. After detection of $V_{op}$ passing a certain threshold the processor 8 generates an end of life signal.

In stead of simply generating an end of life signal the monitoring is preferably used for adapting the display driver device to the display device 1, when the number of output drivers (current sources 10) exceeds the number of columns 2. If one of the current sources 10 remains unconnected to a column (in the example of FIG. 1 this is show for column n) its current is zero, so the $V_{ds}$ value tends to be biased at point O and $V_{op}$ tends to a value $V_{supply}$. Via the operational amplifier 13, the voltage line 11 now, via a positive feedback mechanism tends to increase indefinitely (although this increase is limited by the externally provided voltages).

Figure 3:
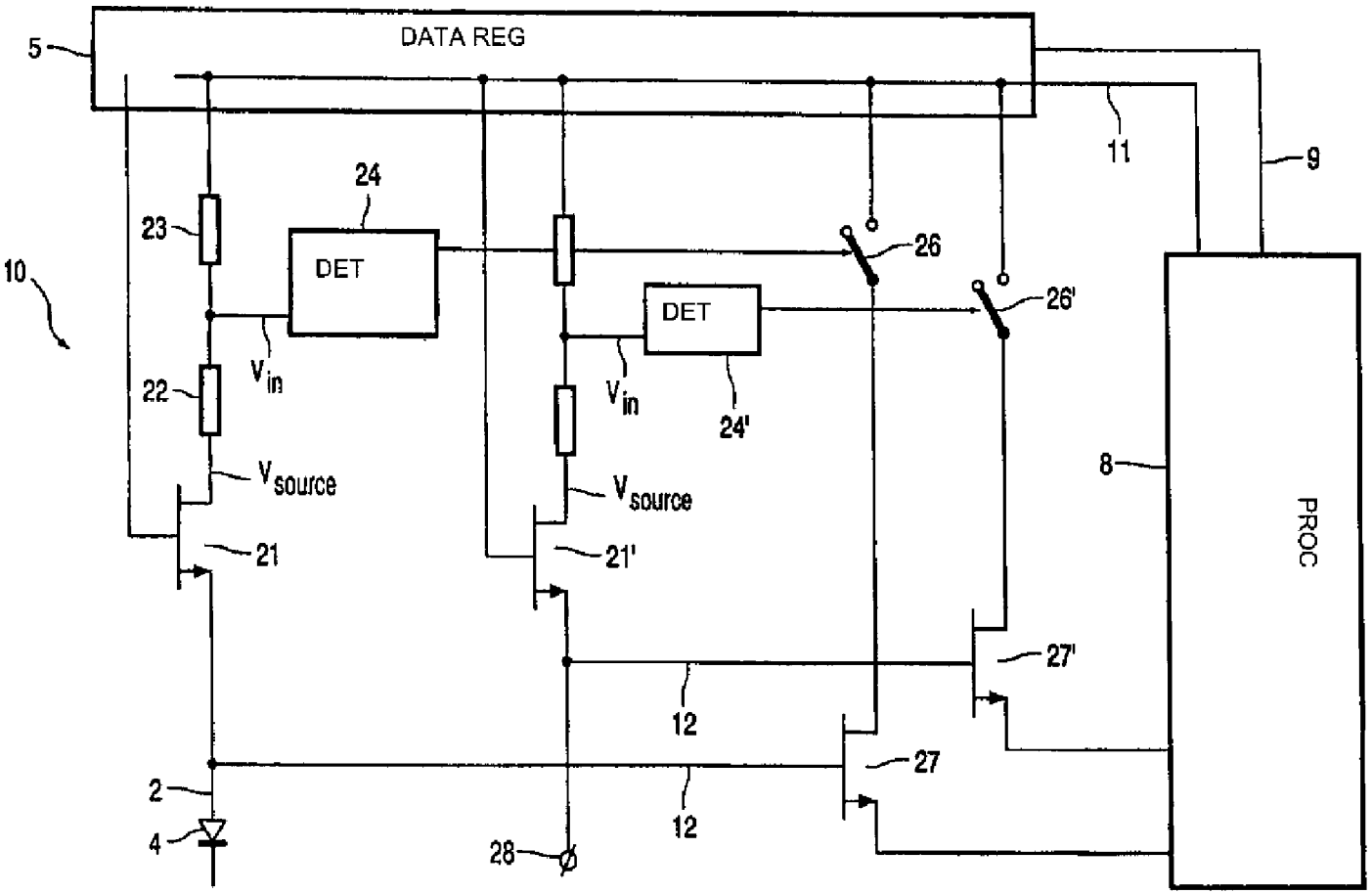

According to the invention however a similar detection mechanism as described above is incorporated in the processor 8, which stops further increase of $V_{op}$ at a certain threshold (e.g. when $V_{op,max}$ approaches the value $V_{supply}-V_{ds,min}$ FIG. 3 shows a more detailed embodiment having two current sources 10, one being interconnected to a LED 4, the other having an (open) output 28. Each current source comprises a transistor 21 and two resistors 22, 23 connected in series, their common point being interconnected to a detecting circuit 24,24', providing the detecting circuit 24,24' with an input voltage $V_{in}$. In the detecting circuit 24,24' the current through the current source is monitored and compared with a certain threshold as mentioned above. The interconnections 12 control via transistors 27 and 26, 26' the voltage line 11 to remain at $V_{op,max}+V_{ds}$. In case of an open output it will be clear that the current through the current source is zero and consequently it holds that $V_{in}=V_{supply}$ or $V_{in}=V_{source}$. Upon detecting this in e.g. detecting circuit 24', which corresponds to open output 28 the switch 26' is opened and the control mechanism is interrupted, so this open output 28 no longer functions in the feedback mechanism as described.

Figure 4:
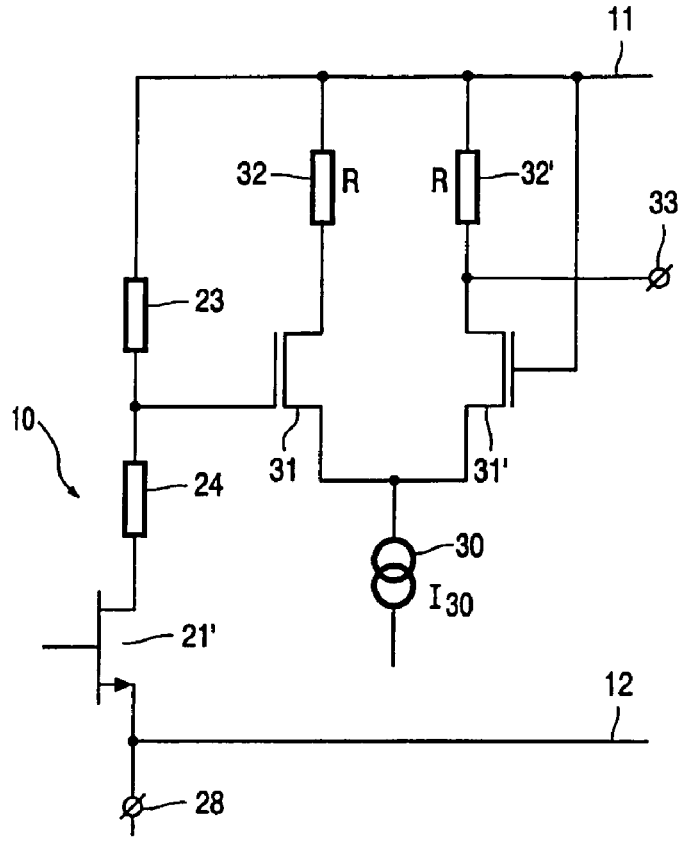
FIGS. 4 and 5 show further embodiments of the driver circuit according to the invention, and The Figures are diagrammatic; corresponding components are generally denoted by the same reference numerals.

The open output is e.g. detected by means of the circuit of FIG. 4, in which the detecting circuit 24 comprises a differential amplifier having a current source 30, two transistors 31 and in this example two resistors 32 of value R. If no current flows in transistor 21, the common point of the two resistors 22, 23 has a voltage equal to the voltage at line 11, so in both transistors 31 half of the current $I_{30}$ flows, leading to a voltage $V_{op,max}+V_{ds}-\frac{1}{2}I_{30}.R$ at output 33. This voltage is chosen to have such a value that the corresponding switch 26' is opened.

By subsequently selecting the transistors 21 via their gate terminals while having their drain terminals connected to a suitable voltage and keeping all other transistors 21 off the column outputs can also be supplied subsequently with a certain current I (preferably close to $I_{max}$) to test all column outputs.

Figure 5:
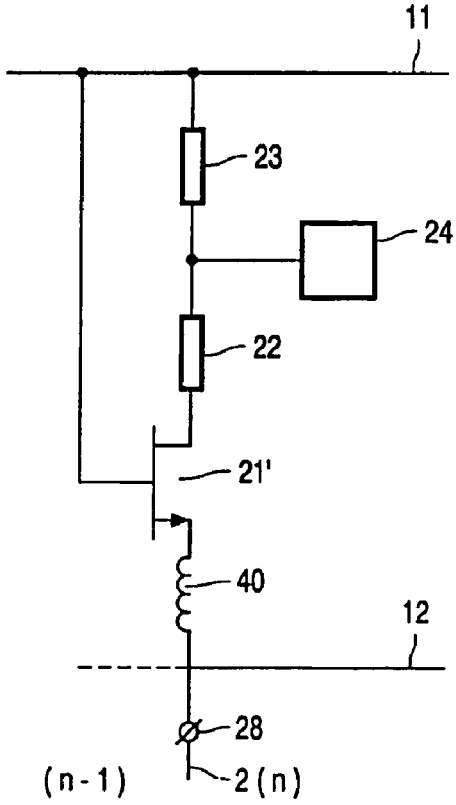

Especially if a number of columns is not used and the driver is not intended for any (further) use with another number of columns it may be sufficient to introduce a fuse 40 between transistor 21 and output 28 (FIG. 5). The number of superfluous outputs can then be eliminated by selecting the corresponding transistors 21 and supplying appropriate voltages to their corresponding interconnections 12 and voltage line 11.

The protective scope of the invention is not limited to the embodiments described. The invention is applicable to both active and passive devices, matrix and segmented display devices. Since the driver device may be intended for different kinds of display devices (size, dissipation, voltages) the reference voltage or voltage differences which are monitored may be programmable. The invention is also applicable to field emission devices and other devices based on current driving.

The invention resides in each and every novel characteristic feature and each and every combination of features. Reference numerals in the claims do not limit the protective scope of these claims. The use of the verb "to comprise" and its conjugations does not exclude the presence of elements other than those stated in the claims. The use of the article "a" or "an" preceding an element does not exclude the presence of a plurality of such elements.

The invention claimed is:

1. A display device comprising:

a number of picture elements; and a display driver device, comprising:

driving transistors to be connected in series with the picture elements;

means for monitoring output voltages at output nodes of the display driver device;

a feedback mechanism configured to operate in response to the output voltages to control a reference voltage of the display driver device and to maintain substantially constant a voltage value between a supply node and the output nodes;

means for detecting one or more open outputs at one or more of the output nodes of the display driver device; and means for inhibiting the feedback mechanism from responding to the output voltages at the one or more output nodes having the open outputs upon detection by the detecting means of the one or more open outputs.

2. The display device as claimed in claim 1, further comprising means for signaling when an output voltage reaches a threshold voltage.

3. The display device as claimed in claim 1, wherein the feedback mechanism further comprises a control circuit for signaling a difference between an output voltage of the display driver device for a picture element and the reference voltage being below a threshold voltage.

4. The display device as claimed in claim 3, wherein the means for detecting the open output are configured to perform the detecting after the signaling.

5. The display device as claimed in claim 3, wherein the means for detecting includes a differential amplifier.

6. The display device as claimed in claim 1, wherein the display driver device comprises current sources each including one of the transistors, and the feedback mechanism is configured for keeping substantially constant a difference between an output voltage of the display driver device for a picture element and the reference voltage.

7. The display device as claimed in claim 1, wherein the picture elements include a luminescent element having a luminescence determined by first current.

8. The display device of claim 1, wherein the means for inhibiting includes a plurality of switches connected between the supply node and the output nodes, wherein one or more of the switches are opened upon detection of the one or more open outputs.

9. A display driver device comprising:

driving transistors to be connected in series with picture elements;

means for monitoring output voltages at output nodes of the display driver device;

a feedback mechanism configured to operate in response to the output voltages to control a reference voltage of the display driver device and to maintain substantially constant a voltage value between a supply node and the output nodes; and a detector including a differential amplifier for detecting one or more open outputs at one or more of the output nodes of the display driver device and inhibiting the feedback mechanism from responding to the outpost voltages at the one or more output nodes having upon detection by the detecting means of the one or more open outputs.

10. The display driver device as claimed in claim 9, further comprising means for signaling when an output voltage reaches a threshold voltage.

11. The display driver as claimed in claim 9, wherein the feedback mechanism further comprises a control circuit for signaling a difference between an output voltage of the display driver device for a picture element and the reference voltage being below a threshold voltage.

12. The display driver device of claim 9, wherein the detector includes a plurality of switches connected between the supply node and the output nodes, wherein one or more of the switches are opened upon detection of the one or more open outputs.

13. A display driver, comprising:

a plurality of current sources for supplying current to pixels of a display device, each current source being connected to an output node of the display driver; means for monitoring output voltages at the output nodes; a feedback mechanism configured to operate in response to the output voltages to control a reference voltage of the display driver and to maintain substantially constant a voltage value between a supply node and the output nodes; and means for inhibiting the feedback mechanism from responding to the output voltages at one or more output nodes which have open outputs.

means for detecting one or more open outputs at one or more of the output nodes, and wherein the means for inhibiting includes a plurality of switches connected between the supply node and the output nodes, wherein one or more of the switches are opened upon detection of the one or more open outputs.

14. The display driver of claim 13, wherein the means for inhibiting comprises a plurality of fuses.

* * * * *